US012234081B2

(12) United States Patent
Okuyama

(10) Patent No.: US 12,234,081 B2
(45) Date of Patent: Feb. 25, 2025

(54) CELL BOX AND CELL BOX DEVICE

(71) Applicant: Sharp Display Technology Corporation, Kameyama (JP)

(72) Inventor: Koji Okuyama, Kameyama (JP)

(73) Assignee: Sharp Display Technology Corporation, Kameyama (JP)

( * ) Notice: Subject to any disclaimer, the term of this patent is extended or adjusted under 35 U.S.C. 154(b) by 4 days.

(21) Appl. No.: 18/138,108

(22) Filed: Apr. 23, 2023

(65) Prior Publication Data

US 2023/0339671 A1 Oct. 26, 2023

(30) Foreign Application Priority Data

Apr. 25, 2022 (JP) ..... 2022-071829

(51) Int. Cl.
*B65D 85/30* (2006.01)
*B65D 81/05* (2006.01)

(52) U.S. Cl.
CPC ..... *B65D 85/30* (2013.01); *B65D 81/05* (2013.01)

(58) Field of Classification Search
CPC ..... B65D 85/30; B65D 81/05; B65D 85/48; B65D 25/107; B65D 25/101; B65D 25/10; B65D 81/054
USPC ..... 206/706, 586, 453, 454, 449
See application file for complete search history.

(56) References Cited

U.S. PATENT DOCUMENTS 5,398,808 A * 3/1995 Chen ..... B65D 5/5071 206/320
5,447,234 A * 9/1995 Faulstick ..... B65D 25/10 206/455
9,227,765 B1 1/2016 Zhao et al.
9,643,772 B2 * 5/2017 Yue ..... B65D 85/48
10,392,176 B1 * 8/2019 Hu ..... B65D 85/48
10,562,671 B2 * 2/2020 Liang ..... B65D 25/10
10,597,215 B2 * 3/2020 Zhao ..... B65D 81/052
2013/0156537 A1 * 6/2013 Lo ..... H01L 21/67346 414/800
2013/0299375 A1 * 11/2013 Chen ..... B29C 39/26 264/219
2014/0138272 A1 * 5/2014 Kuo ..... B65D 81/107 206/454
2015/0041361 A1 * 2/2015 Hong ..... B65D 81/107 206/723
2016/0001964 A1 * 1/2016 Yue ..... B65D 85/48 206/555
2020/0189825 A1 * 6/2020 Nakamichi ..... B65D 85/48

FOREIGN PATENT DOCUMENTS

JP 3210846 U 6/2017
JP 2017526590 A 9/2017

* cited by examiner

*Primary Examiner* — Steven A. Reynolds
(74) *Attorney, Agent, or Firm* — ScienBiziP, P.C.

(57) ABSTRACT

A cell box includes a bottom plate on which an object to be packed is placed, a sidewall formed at a peripheral edge of the bottom plate, and a spacer that is switched between a first state where one end of the spacer protrudes by a first distance from a sidewall toward a side of an accommodation space accommodating the object to be packed, and a second state where the one end does not protrude from the sidewall toward the side of the accommodation space.

12 Claims, 13 Drawing Sheets

CELL BOX AND CELL BOX DEVICE

CROSS-REFERENCE TO RELATED APPLICATIONS

This application claims the benefit of priority to Japanese Patent Application Number 2022-071829 filed on Apr. 25, 2022. The entire contents of the above-identified application are hereby incorporated by reference.

BACKGROUND

Technical Field

The disclosure relates to a cell box and a cell box device for packing an object to be packed in which a printed circuit board is connected to a display panel via a flexible substrate.

There is known a cell box in the related art (JP 2017-526590 T and JP 3210846 UM-B) in which, in a cell box for packing an object to be packed in which a printed circuit board is connected to a display panel via a plurality of flexible substrates, the object to be packed and a packing material closely contact each other without a gap, and thus, the generation of a secondary impact when the object to be packed moves during transportation can be prevented, and the degree of damage on the object to be packed due to an impact from the outside can be reduced.

The cell boxes disclosed in JP 2017-526590 T and JP 3210846 UM-B include a bottom plate on which an object to be packed is placed, and a sidewall formed at a peripheral edge of the bottom plate. An engagement groove is vertically formed in the bottom plate at an inner peripheral side of the sidewall corresponding to the printed circuit board. In addition, a notch portion is formed between the plurality of flexible substrates. An engagement member including a first arm to be inserted into the engagement groove, a second arm to be inserted into the notch portion, and a coupling portion connecting the first arm and the second arm, is set so as to span across the printed circuit board to fix the printed circuit board.

SUMMARY

However, in the related art described above, when the engagement member is set to fix the printed circuit board, it is necessary to insert the first arm into the engagement groove and insert the second arm into the notch portion, and when the engagement member is released, it is necessary to detach the first arm from the engagement groove and detach the second arm from the notch portion. Therefore, there is a problem in that operations for fixing and releasing the printed circuit board are complicated.

It is an object of an aspect of the disclosure to realize a cell box and a cell box device capable of fixing and releasing, by a simple operation, an object to be packed.

In order to solve the problems described above, a cell box according to an aspect of the disclosure is a cell box for packing an object to be packed including a display panel connected to a printed circuit board via a flexible substrate, and the cell box includes a bottom plate on which the object to be packed is placed, a plurality of sidewalls formed at a peripheral edge of the bottom plate, and a spacer configured to be switched between a first state where one end of the spacer protrudes by a first distance from one sidewall among the plurality of sidewalls toward an accommodation space configured to accommodate the object to be packed, and a second state where the one end protrudes by a second distance shorter than the first distance from the one sidewall toward the accommodation space or the one end does not protrude from the one sidewall toward the accommodation space.

In order to solve the problems described above, a cell box device according to an aspect of the disclosure includes a pallet, a plurality of the cell boxes according to the one aspect of the disclosure and being layered on the pallet, and a lid provided to cover an uppermost cell box among the plurality of cell boxes.

According to an aspect of the disclosure, it makes it possible to realize a cell box and a cell box device capable of fixing and releasing, by a simple operation, an object to be packed.

BRIEF DESCRIPTION OF DRAWINGS

The disclosure will be described with reference to the accompanying drawings, wherein like numbers reference like elements.

DESCRIPTION OF EMBODIMENTS

First Embodiment

Figure 1:
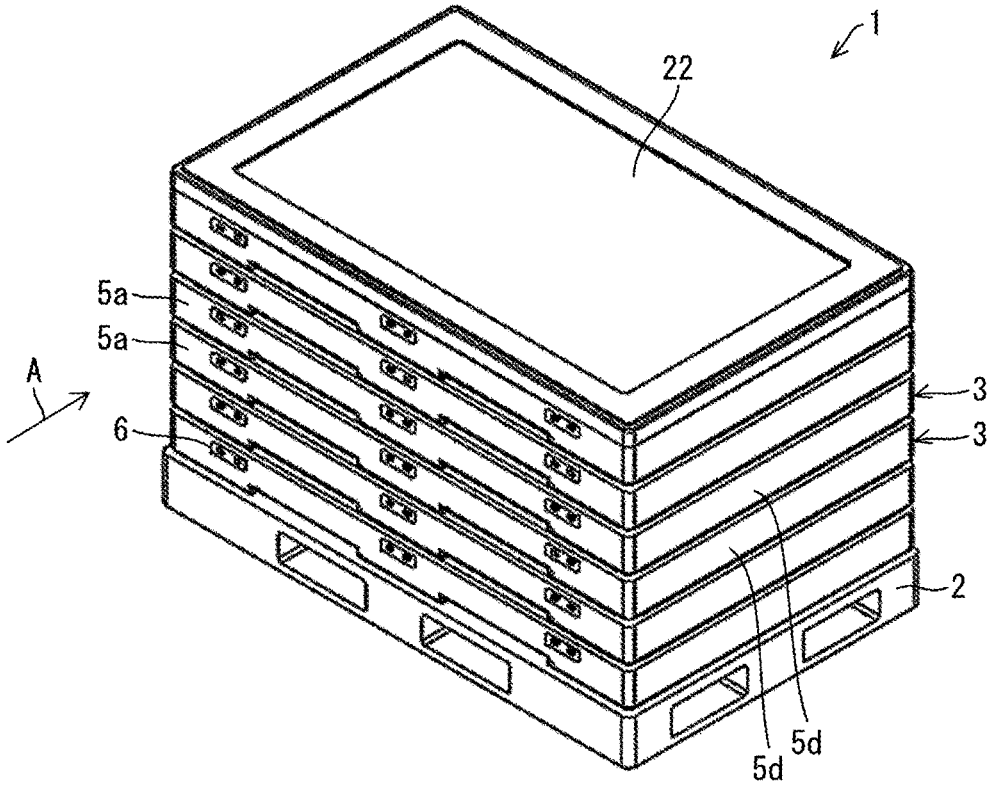
FIG. 1 is a perspective view of a cell box device according to a first embodiment.
Figure 2:
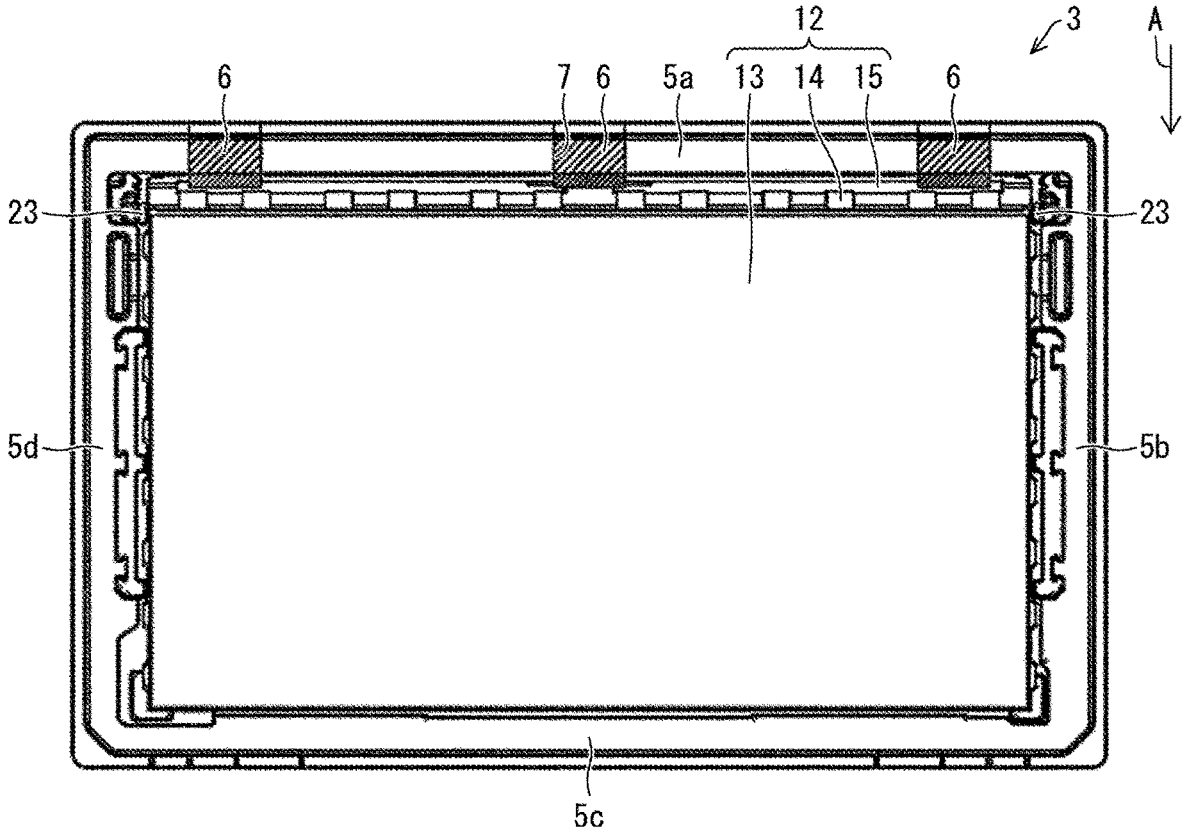
FIG. 2 is a plan view of a cell box provided in the cell box device in a state where a spacer is set.
Figure 3:
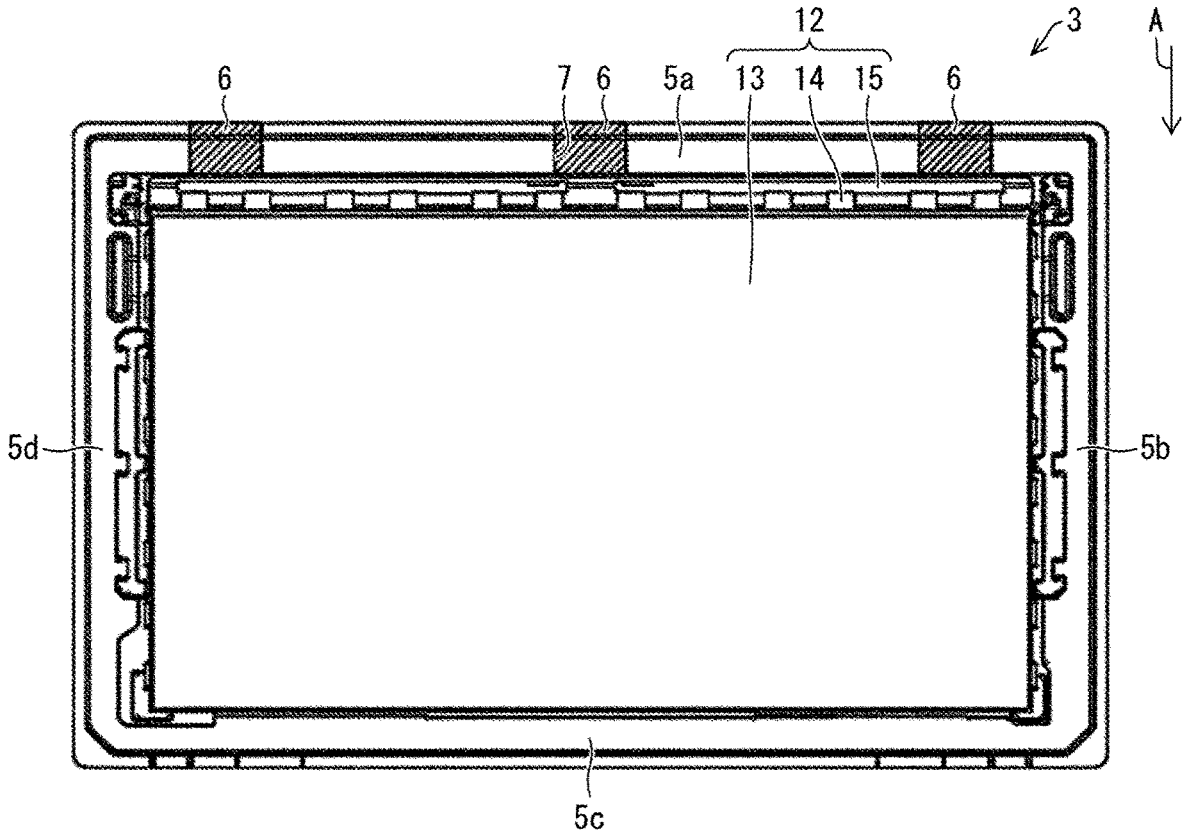
FIG. 3 is a plan view of the cell box in a state where the spacer is released.
Figure 4:
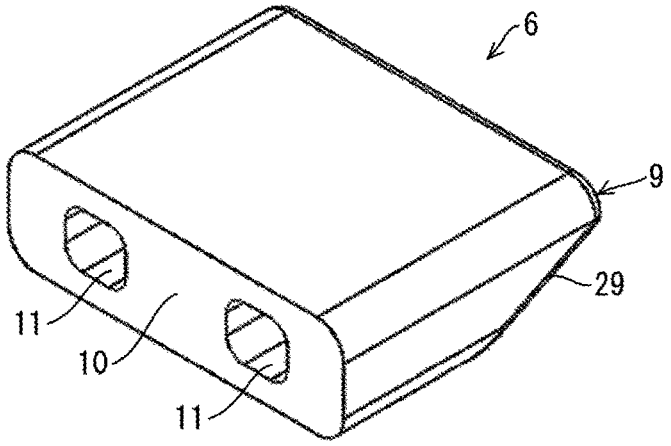
FIG. 4 is a perspective view of the spacer provided in the cell box.
Figure 5:
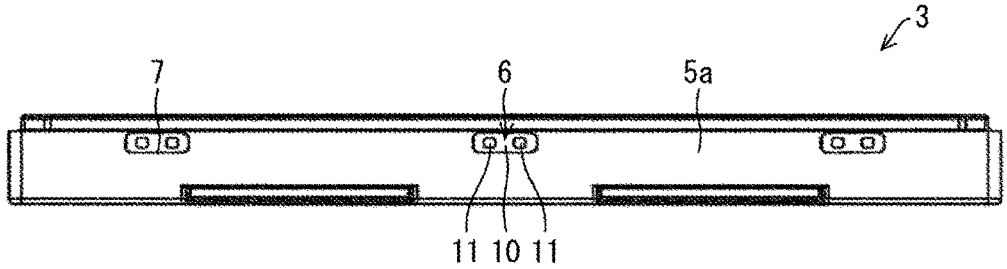
FIG. 5 is a front view of a sidewall provided in the cell box.
Figure 6:
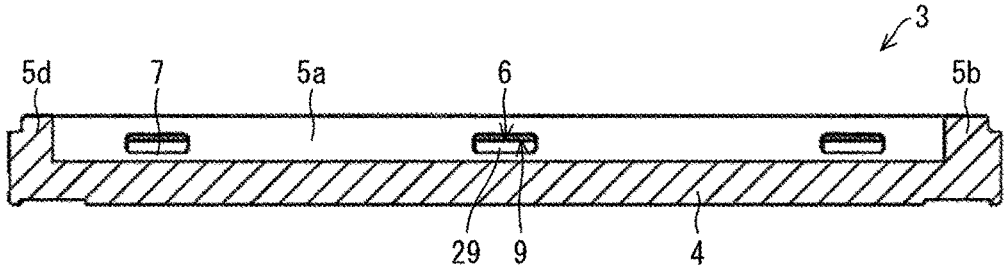
FIG. 6 is a back view of the sidewall.
Figure 7:
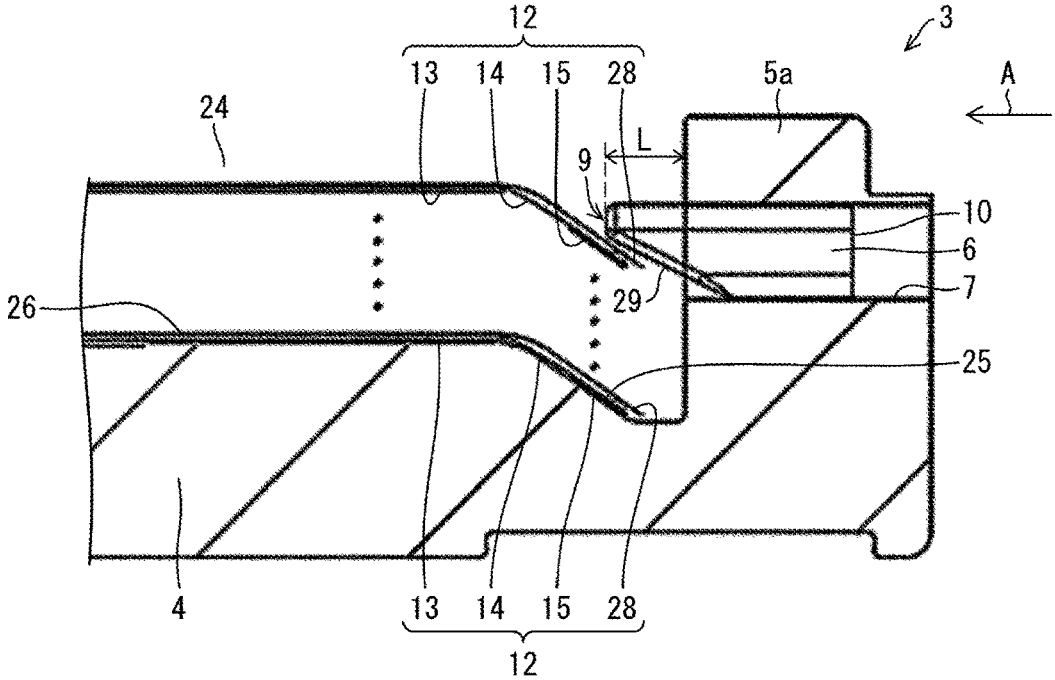
FIG. 7 is a cross-sectional view of a bottom plate and the sidewall provided in the cell box in the state where the spacer is set.
Figure 8:
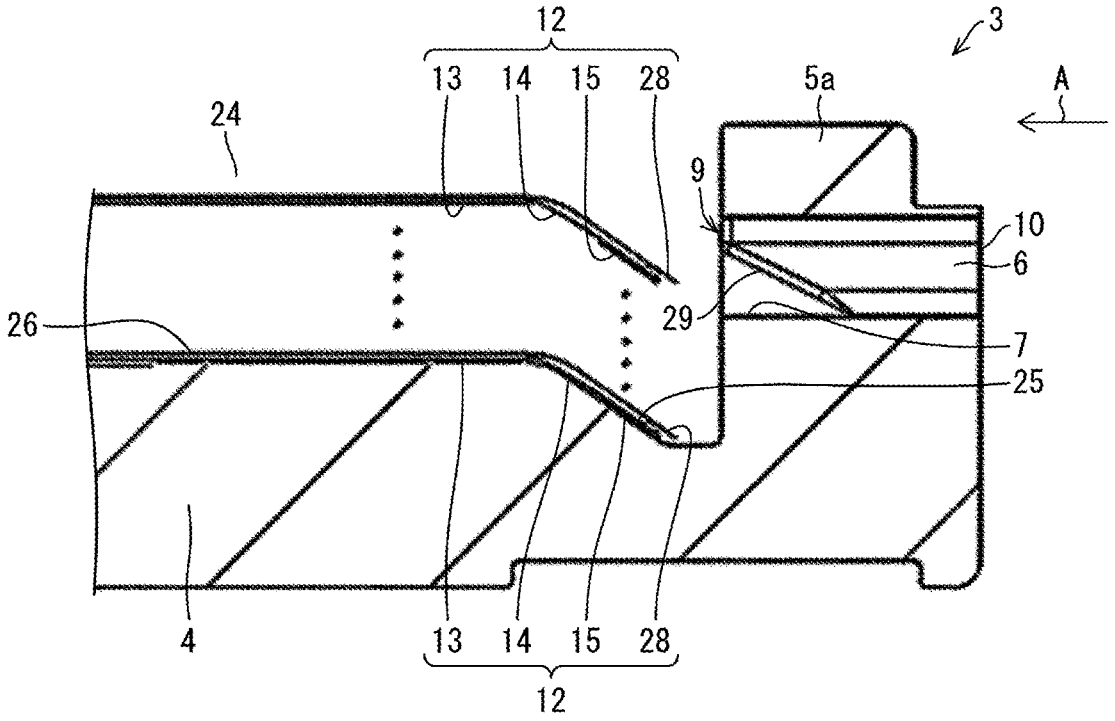
FIG. 8 is a cross-sectional view of the bottom plate and the sidewall provided in the cell box in the state where the spacer is released.

Hereinafter, an embodiment of the disclosure will be described in detail. FIG. 1 is a perspective view of a cell box device 1 according to a first embodiment. FIG. 2 is a plan view of a cell box 3 provided in the cell box device 1 in a state where a spacer is set. FIG. 3 is a plan view of the cell box 3 in a state where the spacer is released. FIG. 4 is a perspective view of a spacer 6 provided in the cell box 3. FIG. 5 is a front view of a sidewall 5 provided in the cell box 3. FIG. 6 is a back view of the sidewall 5. FIG. 7 is a cross-sectional view of a bottom plate 4 and the sidewall 5 provided in the cell box 3 in the state where the spacer is set. FIG. 8 is a cross-sectional view of the bottom plate 4 and the sidewall 5 provided in the cell box 3 in the state where the spacer is released.

As illustrated in FIG. 1, the cell box device 1 includes a pallet 2, a plurality of cell boxes 3 layered on the pallet 2, and a lid 22 provided to cover the uppermost cell box 3 among the plurality of cell boxes 3.

For example, as illustrated in FIGS. 2 and 3, an object to be packed 12 in which a printed circuit board 15 is connected to a display panel 13 via a flexible substrate 14 is packed in each of the cell boxes 3. The printed circuit board 15 may be a source substrate, for example.

As illustrated in FIGS. 7 and 8, a protective sheet 28 is provided so as to cover the display panel 13, the flexible substrate 14, and the printed circuit board 15. In FIGS. 2 and 3, the protective sheet 28 is omitted for ease of understanding.

The cell box 3 includes the bottom plate 4 having a rectangular shape on which an object to be packed 12 is placed, sidewalls 5*a*, 5*b*, 5*c*, and 5*d* formed at a peripheral edge of the bottom plate 4, and the spacer 6. The sidewalls 5*a*, 5*b*, 5*c*, and 5*d* are provided at positions corresponding the respective four sides of the bottom plate 4. The spacer 6 is arranged in one sidewall among the plurality of sidewalls 5*a*, 5*b*, 5*c*, and 5*d* (in the present embodiment, the sidewall 5*a*). The spacer 6 may be arranged in two or more sidewalls among the plurality of sidewalls 5*a*, 5*b*, 5*c*, and 5*d*.

The state of the spacer 6 is switched between a first state illustrated in FIG. 7 and a second state illustrated in FIG. 8. The first state is a state where one end 9 of the spacer 6 protrudes by a first distance L from the sidewall 5*a* (the one sidewall) toward the side of an accommodation space 24 accommodating the object to be packed 12, and corresponds to a state where the spacer is set in the cell box 3. The second state is a state where the one end 9 of the spacer 6 protrudes from the sidewall 5*a* toward the side of the accommodation space 24 by a second distance shorter than the first distance L or the one end 9 does not protrude from the sidewall 5*a* toward the side of the accommodation space 24, and corresponds to a state where the spacer is released in the cell box 3.

In the first state, a portion of the spacer 6 protruding from the sidewall 5*a* faces or contacts the printed circuit board 15 to press the printed circuit board 15. For example, the spacer 6 includes, on the side of the one end 9, a pressing surface 29 that is inclined so that a thickness of the spacer 6 increases toward an outer end face 10. In the present embodiment, the pressing surface 29 faces or contacts the printed circuit board 15 in the first state. In the first state, the pressing surface 29 may contact the printed circuit board 15, may face the printed circuit board 15 with a gap therebetween, or may contact the protective sheet 28 to face the printed circuit board 15 via the protective sheet 28.

The spacer 6 is provided slidably with respect to the sidewall 5*a*, and is slidable along a first direction indicated by an arrow A, which is parallel to the bottom plate 4 and intersects an inner face of the sidewall 5*a*. However, the spacer 6 may be obliquely slidable with respect to the bottom plate 4.

In the second state, the one end 9 of the spacer 6 may not protrude from the sidewall 5 toward the side of the accommodation space 24 as illustrated in FIG. 8, or may protrude from the sidewall 5 toward the side of the accommodation space 24 by the second distance shorter than the first distance L.

The sidewall 5*a* includes a sliding hole 7 (sliding surface) extending through the sidewall 5*a* along the first direction. The spacer 6 is provided slidably along the sliding hole 7.

For example, as illustrated in FIGS. 4, 7, and 8, the spacer 6 includes the outer end face 10 formed on an outer face side of the sidewall 5*a* and an operation portion formed in the outer end face 10 and used when changing the state of the spacer 6.

The operation portion includes a pair of insertion holes 11 for inserting a finger of an operator. The finger may be a finger of a robot performing an operation. When fingers are inserted into the insertion holes 11, a thumb and an index finger are inserted into the pair of insertion holes 11 to pinch the spacer 6 and pull the spacer 6 outward to move the spacer 6, so that the first state where the spacer 6 is set is changed to the second state where the spacer 6 is released.

The operation portion is not limited to the insertion holes 11, as long as the operation portion has a structure by which the spacer 6 can be pulled outward. For example, the operation portion may be a handle, a string, or a magnet.

As illustrated in FIGS. 7 and 8, a plurality of objects to be packed 12 are layered to be placed on the bottom plate 4. In the first state illustrated in FIG. 7, the spacer 6 presses, via the protective sheet 28, the printed circuit board 15 of the object to be packed 12 layered uppermost among the plurality of objects to be packed 12.

The bottom plate 4 includes a flat surface 26 on which the display panel 13 of the object to be packed 12 is placed and an inclined face 25 inclined so that a thickness of the bottom plate 4 decreases toward the sidewall 5. The printed circuit board 15 and the flexible substrate 14 of the object to be packed 12 are placed on the inclined face 25.

The printed circuit board 15 is provided with a connector for connecting the printed circuit board 15 to the flexible substrate 14. Therefore, a thickness of the connector of the printed circuit board 15 is greater than a thickness of the display panel 13. If the entire surface of the bottom plate 4 of the cell box 3 is flat, the printed circuit board 15 is raised when several of the objects to be packed 12 are stacked and housed. Thus, the printed circuit board 15 is housed on the inclined face 25 to prevent the printed circuit board 15 from rising.

The display panel 13 has a rectangular shape when viewed along a direction perpendicular to a display surface of the display panel 13. The spacer 6 is arranged at a position facing a long side of the rectangle mentioned above. In the cell box 3, three of the spacers 6 are provided at a position facing a center and at positions corresponding to both ends of the long side of the display surface of the display panel 13.

In a cell box of the related art, a main body and a lid form a set. Therefore, a spacer for pressing the printed circuit board 15 can be provided in the lid. However, in a recent trend, a multitiered box system in which a plurality of cell boxes are layered on a pallet is widely spread, and a lid is provided only in the uppermost cell box. Thus, a spacer cannot be provided in each of the plurality of layered cell boxes.

If a spacer is provided on a bottom face of the cell box to be layered, a height of the cell box increases, and when a spacer portion just touches a roller during transport by a roller conveyor in a facility, there may be a problem such as an error in a height sensor. Therefore, the bottom faces of the cell boxes are required to be as flat as possible, and when the cell boxes are layered on the pallet, a projection of the spacer is also present on the bottom face of the lowermost cell box, and thus, the cell boxes are in a bent state. Therefore, there is also a concern about a negative impact on the display panel packed in the cell box.

It is conceivable that only the lowermost cell box is not provided with the spacer. However, in this case, two kinds of cell boxes are required, which increases the cost and complicates the operation.

An object to be packed 12 in which the printed circuit board 15 is connected to the display panel 13 via the flexible substrate 14 is packed/unpacked by a device. Thus, when the spacer is a fixed type, the spacer hinders a packing/unpacking operation.

Therefore, in the present embodiment, the spacer 6 capable of moving is provided. The spacer 6 can be operated from the outside of the sidewall 5*a* of the cell box 3, so that the spacer 6 can be operated in a state where a plurality of cell boxes 3 are layered on the pallet 2.

When the object to be packed 12, which is an open cell (OC) panel, is packed in the cell box 3, the spacer 6 is set in the second state illustrated in FIG. 8 where the spacer 6 is released, and the object to be packed 12 is packed in the cell box 3 in a packing apparatus. As illustrated in FIG. 1, the cell box device 1 is taken out of the packing apparatus in a state where the plurality of cell boxes 3 packed with the objects to be packed 12 are layered on the pallet 2.

Next, as illustrated in FIGS. 2 and 7, the spacer 6 is pressed from an outer wall side of the sidewall 5*a* of the cell boxes 3 layered on the pallet 2 by an operation from an outer wall of the sidewall 5*a* to set the spacer 6, and the printed circuit board 15 is pressed so as not to rattle. As described above, according to the present embodiment, the spacer 6 can be set without re-stacking the cell boxes 3.

In this state, the cell box device 1 is transported, and after arrival at a destination, the spacer 6 is pulled from the outer wall side of the sidewall 5*a*, as illustrated in FIGS. 3 and 8, by an operation from the outer wall of the sidewall 5*a* of the cell boxes 3 layered on the pallet 2 to release the spacer 6, and the plurality of layered cell boxes 3 are fed to an unpacking machine, together with the pallet 2.

The cell box 3 includes a pair of panel holders 23 that hold the display panel 13. The panel holders 23 suppress a movement of the display panel 13 in a horizontal direction toward the printed circuit board 15.

Figure 9:
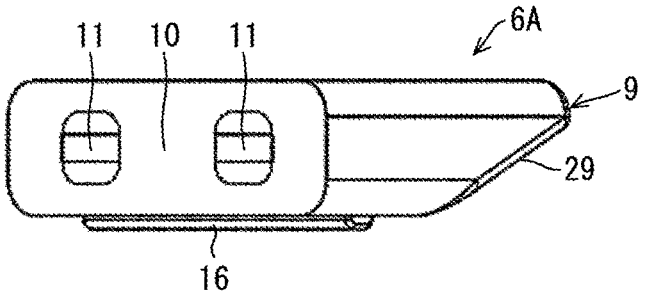
FIG. 9 is a perspective view of a spacer provided in a cell box according to a modified example of the first embodiment.
Figure 10:
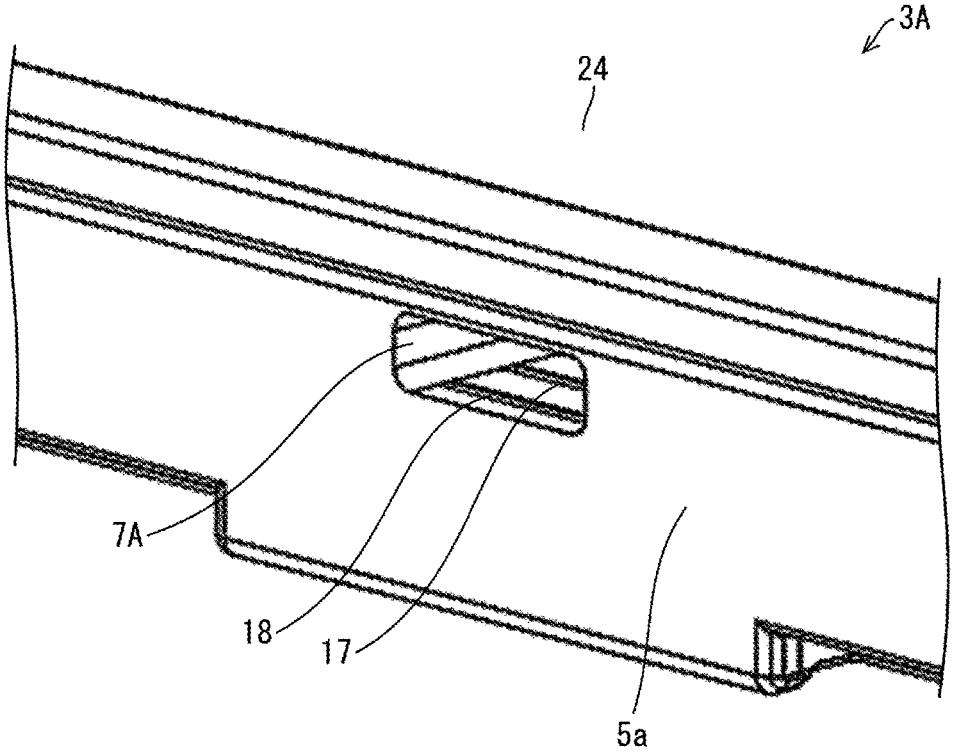
FIG. 10 is a perspective view of a sidewall provided in the cell box.

FIG. 9 is a perspective view of a spacer 6A provided in a cell box 3A according to a modified example of the first embodiment. FIG. 10 is a perspective view of the sidewall 5*a* provided in the cell box 3A, viewed from the outside. The same constituent elements as the above-described constituent elements are denoted with the same reference numerals, and detailed descriptions of such constituent elements are not repeated.

The spacer 6A of the cell box 3A includes a positioning projection 16 (a first fitting portion). A first positioning groove 17 (a second fitting portion, a positioning groove) and a second positioning groove 18 (a second fitting portion, a positioning groove) to be fitted to the positioning projection 16 are formed in a sliding hole 7A. The first positioning groove 17 is formed on the inner side of the sidewall 5 with respect to the second positioning groove 18, that is, on the side of the accommodation space 24.

The first positioning groove 17 is fitted to the positioning projection 16 in the first state where the one end 9 of the spacer 6A protrudes by the first distance L from the sidewall 5*a* toward the side of the accommodation space 24 that accommodates the object to be packed 12. The second positioning groove 18 is fitted to the positioning projection 16 in the second state.

For example, the first positioning groove 17 and the second positioning groove 18 are formed along a direction parallel to the bottom plate 4 and parallel to a longitudinal direction of the sidewall 5 in which the spacer 6A is provided.

The positioning projection 16, the first positioning groove 17, and the second positioning groove 18 further facilitate the operation of the spacer 6A for fixing and releasing the object to be packed 12.

The positioning projection 16, the first positioning groove 17, and the second positioning groove 18 are not limited to the configuration of being provided at the positions of the spacer 6A and the sliding hole 7A illustrated in FIGS. 9 and 10. In the example illustrated in FIGS. 9 and 10, the positioning projection 16 is provided on a bottom face of the spacer 6A, and the first positioning groove 17 and the second positioning groove 18 are provided on a bottom face of the sliding hole 7A. However, the positioning projection 16, the first positioning groove 17, and the second positioning groove 18 may be provided at other positions of the spacer 6A and the sliding hole 7A. For example, the positioning projection 16 may be provided on a side surface of the spacer 6A, and the first positioning groove 17 and the second positioning groove 18 may be provided on a sidewall of the sliding hole 7A.

The positioning projection 16 may be formed in the sliding hole 7A, and the first positioning groove 17 and the second positioning groove 18 may be formed in the spacer 6A.

Second Embodiment

Figure 11:
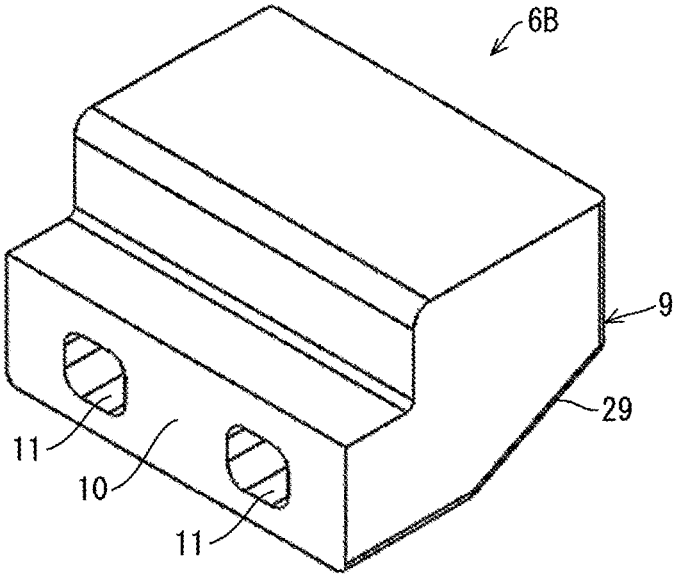
FIG. 11 is a perspective view of a spacer provided in a cell box according to a second embodiment.
Figure 12:
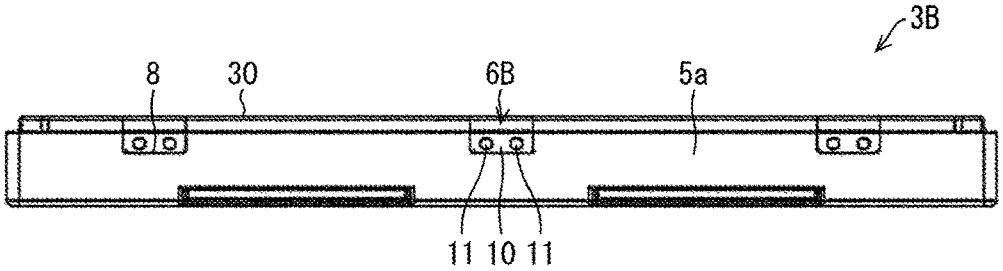
FIG. 12 is a front view of a sidewall provided in the cell box.
Figure 13:
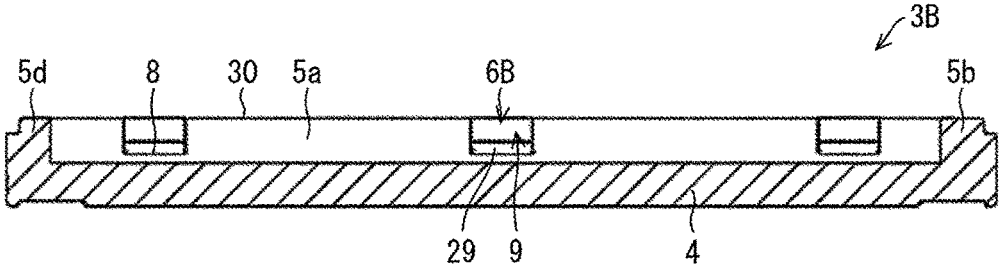
FIG. 13 is a back view of the sidewall.
Figure 14:
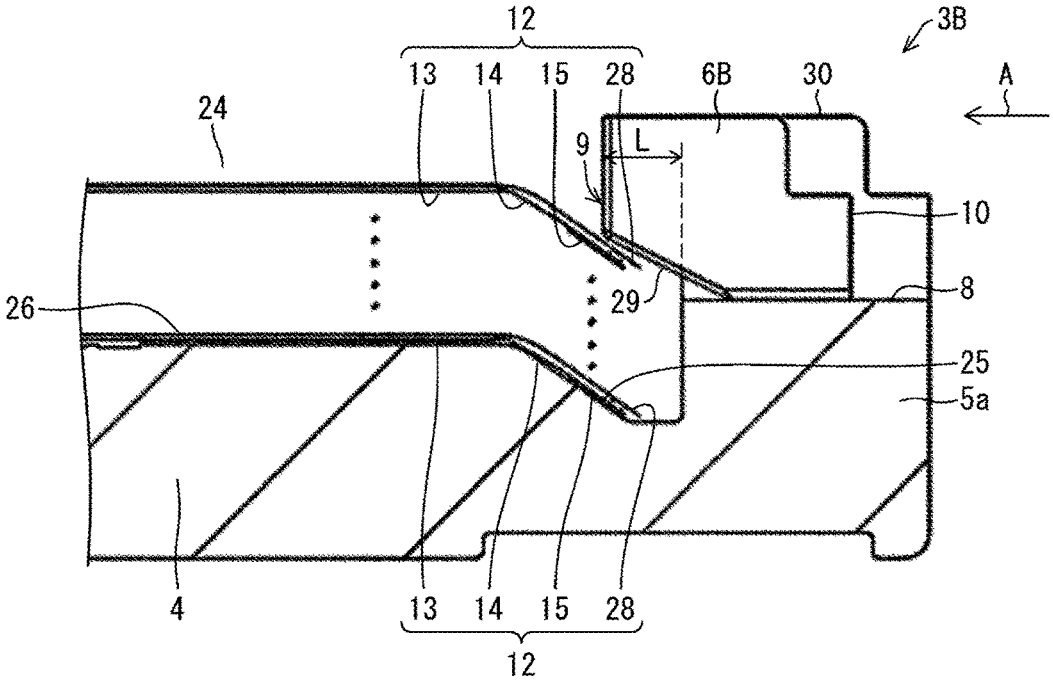
FIG. 14 is a cross-sectional view of a bottom plate and the sidewall provided in the cell box in a state where the spacer is set.
Figure 15:
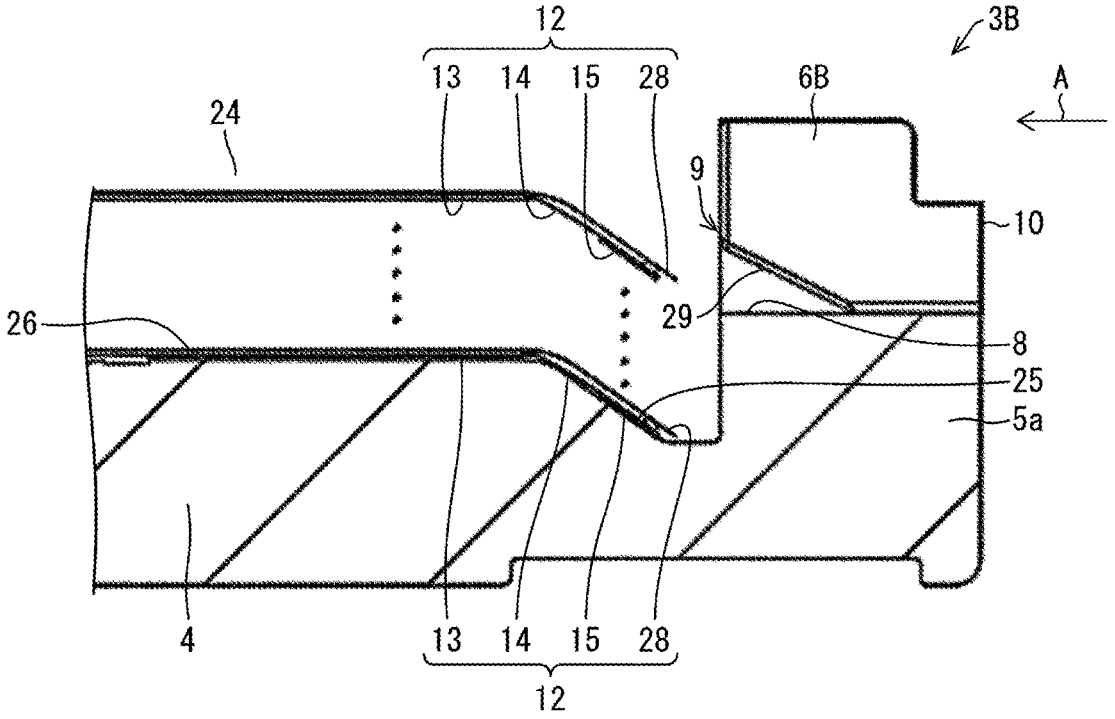
FIG. 15 is a cross-sectional view of the bottom plate and the sidewall provided in the cell box in a state where the spacer is released.

FIG. 11 is a perspective view of a spacer 6B provided in a cell box 3B according to a second embodiment. FIG. 12 is a front view of the sidewall 5*a* provided in the cell box 3B. FIG. 13 is a back view of the sidewall 5*a*. FIG. 14 is a cross-sectional view of the bottom plate 4 and the sidewall 5*a* provided in the cell box 3B in a state where the spacer is set. FIG. 15 is a cross-sectional view of the bottom plate 4 and the sidewall 5*a* provided in the cell box 3B in a state where the spacer is released. The same constituent elements as the above-described constituent elements are denoted with the same reference numerals, and detailed descriptions of such constituent elements are not repeated.

The sidewall 5*a* of the cell box 3B includes an upper face 30 formed on a side opposite to the bottom plate 4 and a sliding groove 8 formed in the upper face 30 and extending along the first direction indicated by an arrow A. The cell box 3B includes the spacer 6B provided slidably along the sliding groove 8.

The spacer 6B is obtained by changing the shape of the spacer 6 of the first embodiment. The sliding groove 8 is a spacer mounting portion of the sidewall 5*a* of the cell box 3B, which can be formed more easily when molding the sidewall 5*a*. The sidewall 5*a* formed with the sliding groove 8 can be made by using only a convex mold and a concave mold, unlike the sidewall 5*a* formed with the sliding hole 7 of the first embodiment.

Figure 16:
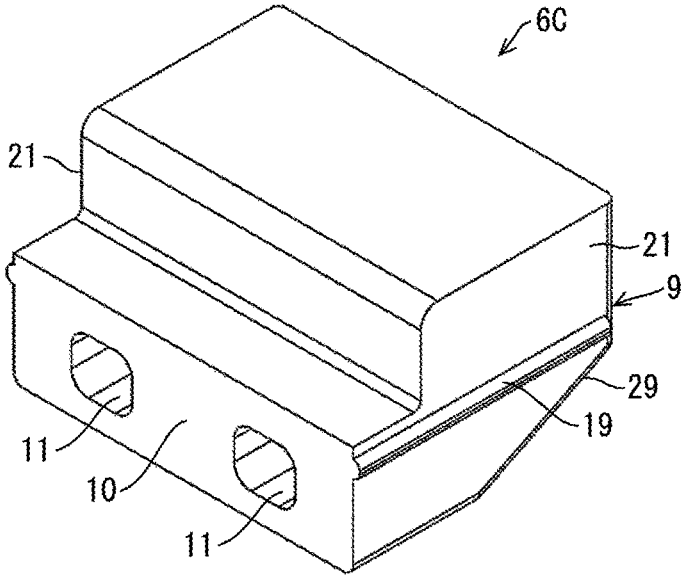
FIG. 16 is a perspective view of a spacer provided in a cell box according to a modified example of the second embodiment.
Figure 17:
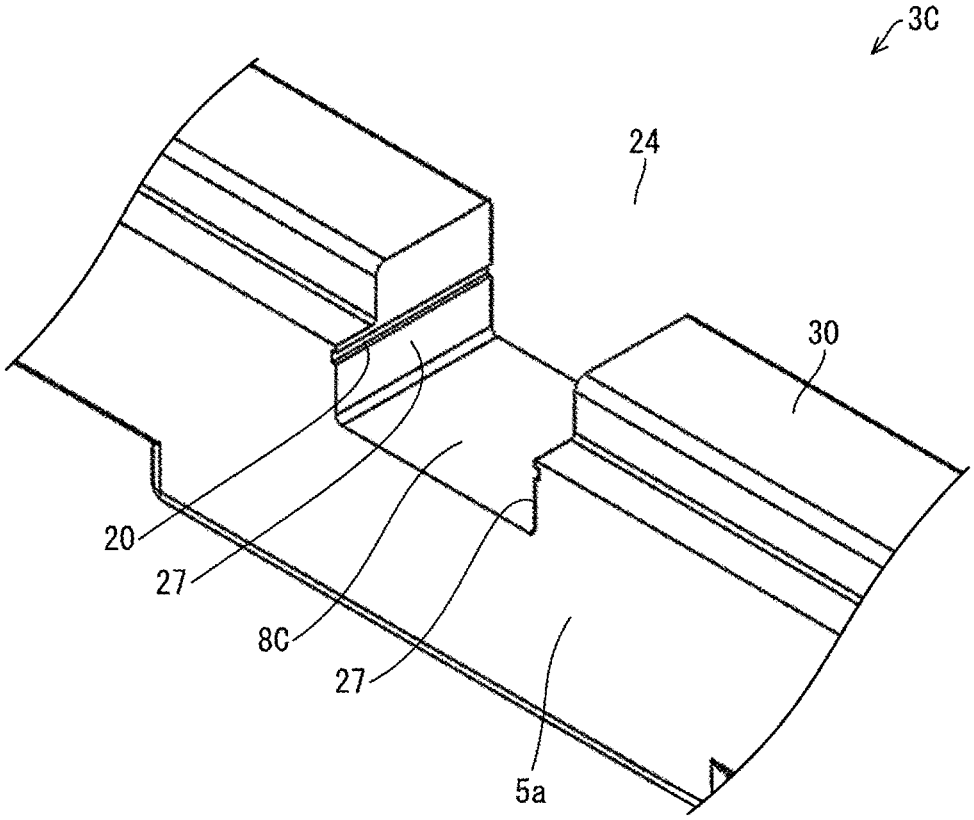
FIG. 17 is a perspective view of a sidewall provided in the cell box.

FIG. 16 is a perspective view of a spacer 6C provided in a cell box 3C according to a modified example of the second embodiment. FIG. 17 is a perspective view of the sidewall 5*a* provided in the cell box 3C, viewed from the outside. The same constituent elements as the above-described constituent elements are denoted with the same reference numerals, and detailed descriptions of such constituent elements are not repeated.

The spacer 6C of the cell box 3C includes a fall prevention projection 19 (first fitting portion). A fall prevention groove 20 (second fitting portion) to be fitted to the fall prevention projection 19 is formed in a sliding groove 8C.

The fall prevention groove 20 is formed in a pair of groove sidewalls 27 of the sliding groove 8C along a sliding direction of the spacer 6C. The fall prevention projection 19 is formed along the sliding direction of the spacer 6C on a pair of spacer side surfaces 21 facing the groove sidewalls 27 of the spacer 6C.

The fall prevention projection 19 and the fall prevention groove 20 prevent the spacer 6C from falling off in an upward direction from the sidewall 5*a*.

The fall prevention projection 19 and the fall prevention groove 20 are not limited to the configuration of being provided at the positions of the spacer 6C and the sliding groove 8C illustrated in FIGS. 16 and 17, and may be provided at other positions of the spacer 6C and the sliding groove 8C.

Note that the fall prevention projection 19 may be formed in the sliding groove 8C and the fall prevention groove 20 may be formed in the spacer 6C.

Third Embodiment

Figure 18:
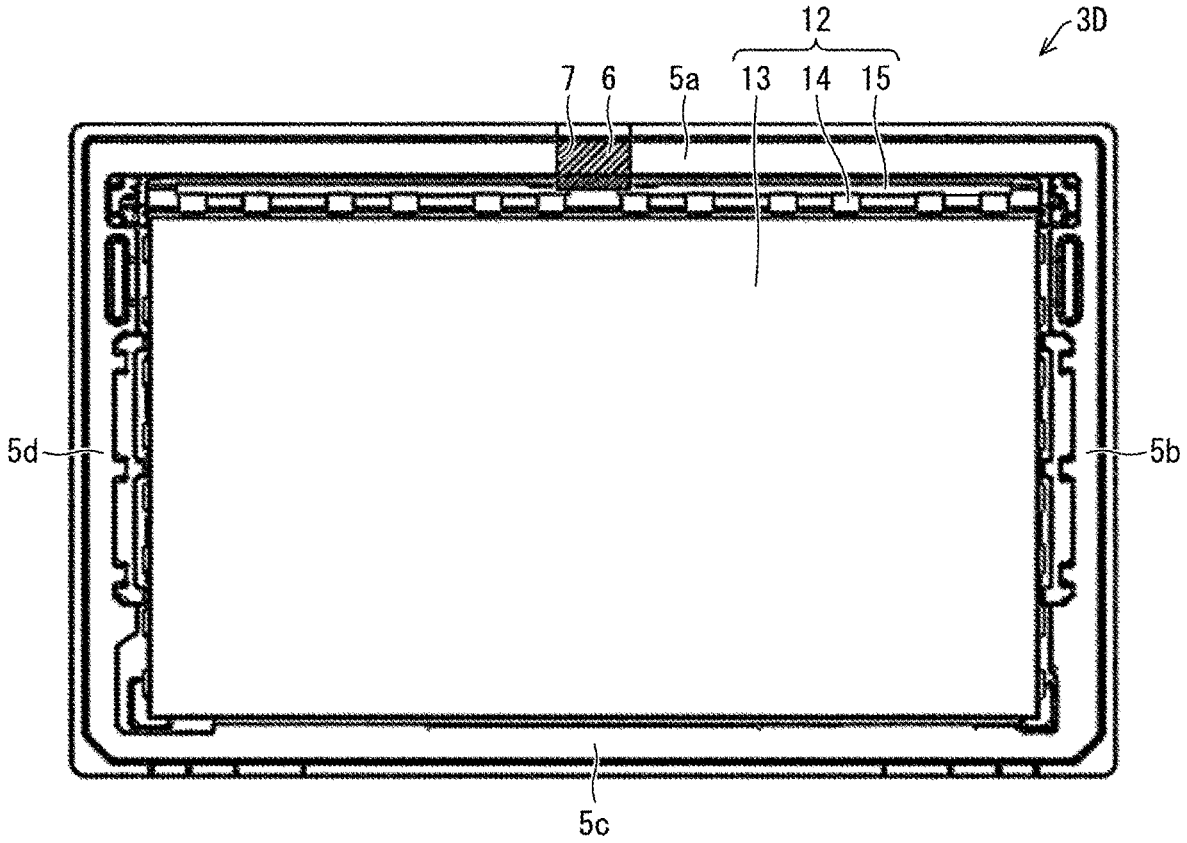
FIG. 18 is a plan view of a cell box according to a third embodiment in a state where the spacer is set.
Figure 19:
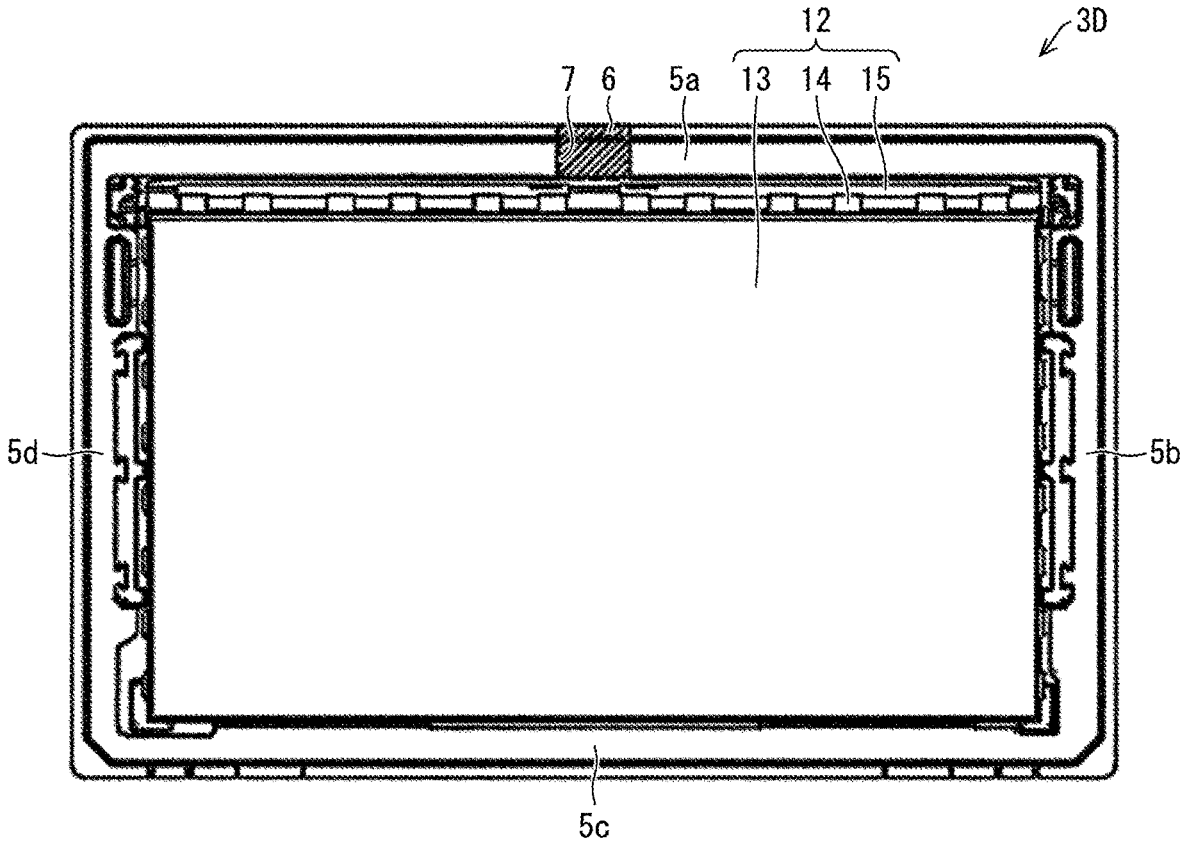
FIG. 19 is a plan view of the cell box in a state where the spacer is released.
Figure 20:
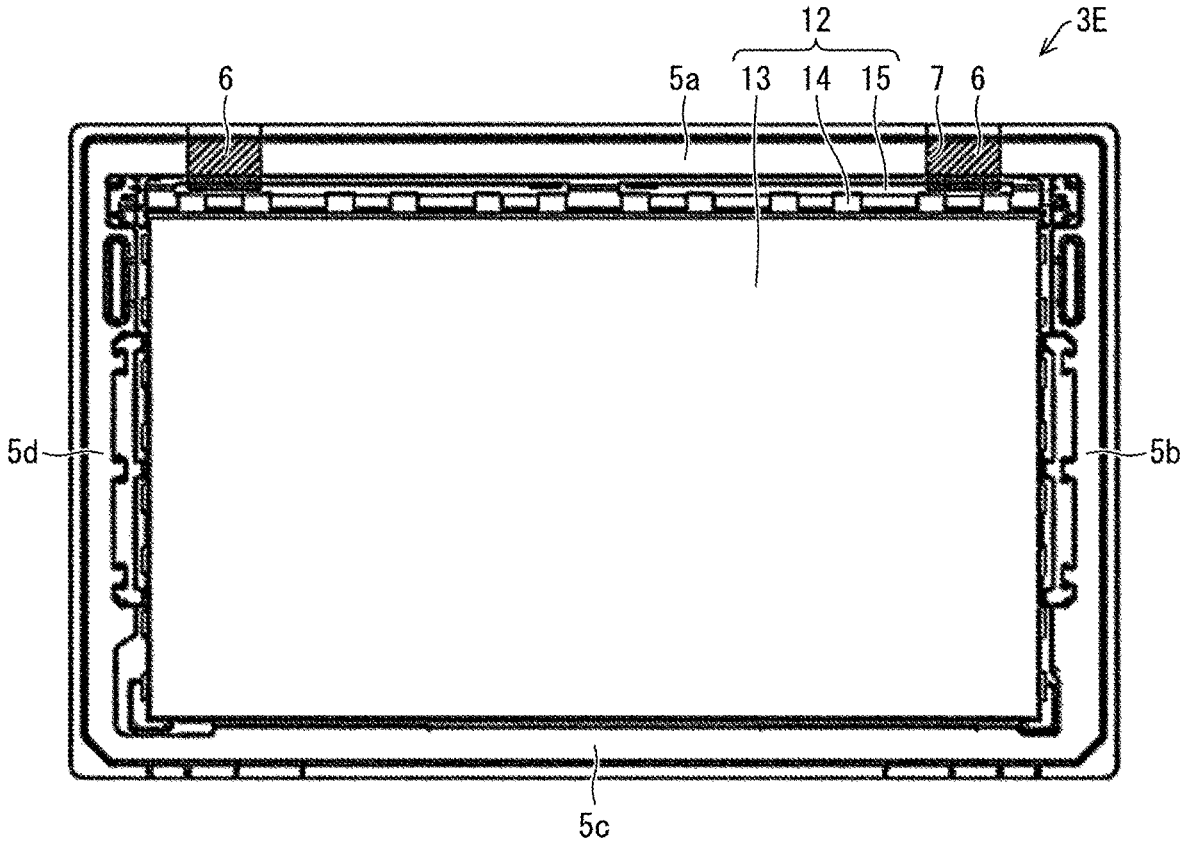
FIG. 20 is a plan view of a cell box according to a modified example of the third embodiment in a state where the spacer is set.
Figure 21:
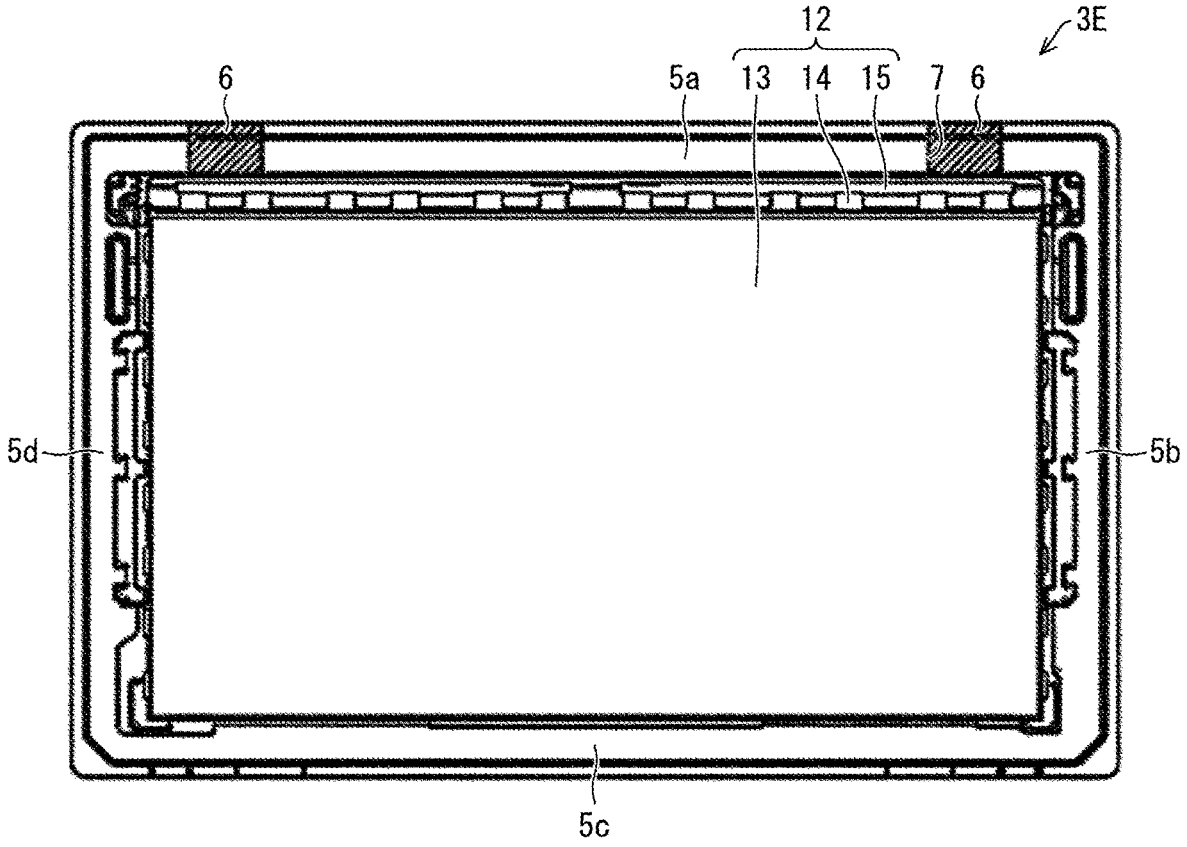
FIG. 21 is a plan view of the cell box in a state where the spacer is released.

FIG. 18 is a plan view of a cell box 3D according to a third embodiment in a state where the spacer is set. FIG. 19 is a plan view of the cell box 3D in a state where the spacer is released. FIG. 20 is a plan view of a cell box 3E according to a modified example of the third embodiment in a state where the spacer is set. FIG. 21 is a plan view of the cell box 3E in a state where the spacer is released. The same constituent elements as the above-described constituent elements are denoted with the same reference numerals, and detailed descriptions of such constituent elements are not repeated.

In the first and second embodiments described above, three of the spacers 6 are provided. However, in the cell box 3D, one spacer 6 is provided at a position facing the center of the long side of the display surface of the display panel 13. In the cell box 3E, two of the spacers 6 are provided at positions corresponding to both ends of the long side of the display surface of the display panel 13. As described above, it is preferable to change the number of spacers 6 depending on the circumstances.

As described above, the inclined face 25 is provided at a part of the bottom plate 4 where the printed circuit board 15 is housed. However, the same cell box 3 is often used for packing different models of the objects to be packed 12 (OC complete panels) having different lengths of the flexible substrate 14, different numbers of the printed circuit boards 15, or different thicknesses of the connector, as long as those models of the objects to be packed 12 have the same inch size. In this case, a spatial distance between the printed circuit board 15 of the uppermost object to be packed 12 and a back surface of the bottom plate 4 of the cell box 3 layered thereon varies depending on the model, so that the spacer 6 needs to be arranged in accordance with the model. For example, if the spatial distance at a center portion is long, it is preferable to arrange the spacer 6 only at one location at the center, as illustrated in FIGS. 18 and 19. If the spatial distance at both ends is long, it is preferable to arrange the spacers 6 at two locations on both ends, as illustrated in FIGS. 20 and 21. In actual packaging, if the spatial distance is long, disconnection of an outer lead of the flexible substrate 14 is likely to occur in a vibration test, and thus, the spacer 6 is arranged at a location where the disconnection occurs.

Supplement

Cell boxes 3, 3A, 3B, 3C, 3D, and 3E according to a first aspect of the disclosure are cell boxes 3 for packing an object to be packed 12 including a display panel 13 connected to a printed circuit board 15 via a flexible substrate 14, and each include a bottom plate 4 on which the object to be packed 12 is placed, a plurality of sidewalls 5*a*, 5*b*, 5*c*, and 5*d* formed at a peripheral edge of the bottom plate 4, and spacers 6, 6A, 6B, and 6C that are switched between a first state where one end 9 of the spacers 6, 6A, 6B, and 6C protrudes by a first distance L from one sidewall 5*a* among the plurality of sidewalls 5*a*, 5*b*, 5*c*, and 5*d* toward a side of an accommodation space 24 accommodating the object to be packed 12, and a second state where the one end 9 protrudes by a second distance shorter than the first distance L from the one sidewall 5*a* toward the side of the accommodation space 24 or the one end 9 does not protrude from the one sidewall 5*a* toward the side of the accommodation space 24.

According to the above-described configuration, the spacer is switched between the first state where the one end of the spacer protrudes by the first distance from the one sidewall toward a side of the accommodation space accommodating the object to be packed and the second state where the one end protrudes from the one sidewall toward the side of the accommodation space by the second distance shorter than the first distance or the one end does not protrude from the one sidewall toward the side of the accommodation space.

Therefore, it makes it possible to provide a cell box in which an object to be packed can be fixed and released by a simple operation of switching between a first state where one end of a spacer protrudes from one sidewall toward a side of an accommodation space by a first distance and a second state where the one end protrudes from the one sidewall toward the side of the accommodation space by the second distance shorter than the first distance or the one end does not protrude from the one sidewall toward the side of the accommodation space.

In the cell boxes 3, 3A, 3B, 3C, 3D, and 3E according to a second aspect of the disclosure, in the first aspect described above, the spacers 6, 6A, 6B, and 6C each include a pressing surface 29 on the side of the one end 9, the pressing surface 29 is inclined facing or contacting the printed circuit board 15, when the spacer 6, 6A, 6B, or 6C is in the first state.

According to the configuration described above, the printed circuit board can be fixed in the first state by the pressing surface formed on the side of the one end of the spacer.

In the cell boxes 3, 3A, 3B, 3C, 3D, and 3E according to a third aspect of the disclosure, in the first or second aspect described above, the spacers 6, 6A, 6B, and 6C are each provided slidably with respect to a sliding surface (sliding holes 7 and 7A, sliding grooves 8 and 8C, and a groove sidewall 27) provided in the one sidewall 5*a*, and are slidable along a first direction intersecting an inner face of the one sidewall 5*a*.

According to the above-described configuration, the spacer can be slid to switch between the first state where the one end of the spacer protrudes by the first distance from the one sidewall toward the side of the accommodation space accommodating the object to be packed, and the second state where the one end of the spacer protrudes from the one sidewall toward the side of the accommodation space by the second distance shorter than the first distance or the one end of the spacer does not protrude from the one sidewall toward the side of the accommodation space.

In the cell boxes 3 and 3A according to a fourth aspect of the disclosure, in the third aspect described above, the one sidewall 5*a* includes a sliding hole 7 or 7A extending through the one sidewall 5*a* along the first direction and configuring the sliding surface, and the spacers 6 and 6A are provided slidably along the sliding holes 7 and 7A.

According to the above-described configuration, the first state and the second state can be switched by sliding the spacer along the sliding hole.

In the cell boxes 3, 3A, 3B, 3C, 3D, and 3E according to a fifth aspect of the disclosure, in any aspect of the first to fourth aspects described above, the spacers 6, 6A, 6B, and 6C each include an outer end face 10 formed on an outer face side of the one sidewall 5*a*, and an operation portion (an insertion hole 11) formed in the outer end face 10 and used at the time of changing a state of the spacers 6, 6A, 6B, and 6C.

According to the above-described configuration, the spacer can be switched between the first state and the second state by using the operation portion formed in the outer end face of the spacer.

In the cell boxes 3, 3A, 3B, 3C, 3D, and 3E according to a sixth aspect of the disclosure, in the fifth aspect described above, the operation portion includes a pair of insertion holes 11 into which fingers of an operator are inserted.

According to the above-described configuration, the object to be packed can be released by a simple operation of inserting fingers into the pair of insertion holes formed in the outer end face of the spacer and pulling the spacer with the fingers.

In the cell boxes 3, 3A, 3B, 3C, 3D, and 3E according to a seventh aspect of the disclosure, in any one aspect of the first to sixth aspects described above, a plurality of the objects to be packed 12 are layered and placed on the bottom plate 4, and in the first state, the spacers 6, 6A, 6B, and 6C press the printed circuit board 15 of the object to be packed 12 layered uppermost among the plurality of objects to be packed 12.

According to the above-described configuration, a cell box in which a plurality of objects to be packed can be fixed and released by a simple operation can be provided.

In the cell boxes 3B and 3C according to an eighth aspect of the disclosure, in the third aspect described above, the one sidewall 5*a* includes an upper face 30 formed on a side opposite to the bottom plate 4 and sliding grooves 8 and 8C formed in the upper face 30, extending along the first direction, and configuring the sliding surface, and the spacers 6B and 6C are provided slidably along the sliding grooves 8 and 8C.

According to the above-described configuration, the first state and the second state of the spacer can be switched by sliding the spacer along the sliding groove.

In the cell boxes 3, 3A, 3B, 3C, 3D, and 3E according to a ninth aspect of the disclosure, in any one aspect of the first to eighth aspects described above, the display panel 13 has a rectangular shape when viewed along a direction perpendicular to a display surface of the display panel 13, and the spacers 6, 6A, 6B, and 6C are each arranged at a position facing a long side of the rectangular shape.

According to the above-described configuration, the printed circuit board connected to the display panel via the flexible substrate can be fixed and released by the spacer arranged at a position facing the long side of the rectangular shape of the display panel.

In the cell box 3A according to a tenth aspect of the disclosure, in the third aspect described above, the spacer 6A includes a positioning projection 16, and a positioning groove (a first positioning groove 17 and a second positioning groove 18) to be fitted to the positioning projection 16 is formed in the sliding surface of the one sidewall 5*a*, or the one sidewall 5*a* includes the positioning projection 16 on the sliding surface, and the positioning groove (the first positioning groove 17 and the second positioning groove 18) is formed in the spacer 6A.

According to the above-described configuration, the spacer is fitted to the sliding surface of the sidewall by the positioning projection of the spacer and the positioning groove formed in the sliding surface of the sidewall, or by the positioning groove of the spacer and the positioning projection formed in the sliding surface of the sidewall.

In the cell box 3A according to an eleventh aspect of the disclosure, in the tenth aspect described above, the positioning groove includes a first positioning groove 17 to be fitted to the positioning projection 16, when the spacer 6A is in the first state, and a second positioning groove 18 to be fitted to the positioning projection 16, when the spacer 6A is in the second state.

According to the above-described configuration, it is easy to position the spacer in the first state and the second state by the positioning projection of the spacer and the first positioning groove and the second positioning groove of the sliding hole.

In the cell box 3C according to a twelfth aspect of the disclosure, in the eighth aspect described above, the spacer 6C includes a fall prevention projection 19, and a fall prevention groove 20 to be fitted to the fall prevention projection 19 is formed in the sliding groove 8C, or the one sidewall 5*a* includes the fall prevention projection 19 in the sliding groove 8C, and the fall prevention groove 20 is formed in the spacer 6C.

According to the above-described configuration, the spacer is prevented from falling off from the sidewall by fitting the fall prevention projection and the fall prevention groove to each other.

In the cell box 3C according to a thirteenth aspect of the disclosure, in the twelfth aspect described above, one of the fall prevention projection 19 or the fall prevention groove 20 is formed along a sliding direction of the spacer 6C in a side surface (a groove sidewall 27) of the sliding groove 8C, and the other of the fall prevention projection 19 or the fall prevention groove 20 is formed along the sliding direction of the spacer 6C in a spacer side surface 21 of the spacer 6C facing the side surface (the groove sidewall 27) of the sliding groove 8C.

According to the above-described configuration, the fall prevention groove formed along the sliding direction of the spacer in the side surface of the sliding groove and the fall prevention projection formed along the sliding direction of the spacer in the spacer side surface facing the side surface of the sliding groove can be fitted to each other.

A cell box device 1 according to a fourteenth aspect of the disclosure includes a pallet 2, the plurality of the cell boxes 3, 3A, 3B, 3C, 3D, and 3E according to any one aspect of the first to thirteenth aspects of the disclosure and being layered on the pallet 2, and a lid 22 provided so as to cover the uppermost cell box among the plurality of cell boxes 3, 3A, 3B, 3C, 3D, and 3E.

The disclosure is not limited to the embodiments described above, and various modifications may be made within the scope of the claims. Embodiments obtained by appropriately combining technical approaches disclosed in the different embodiments also fall within the technical scope of the disclosure. Furthermore, novel technical features can be formed by combining the technical approaches disclosed in each of the embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A cell box for packing an object to be packed, the object to be packed including a display panel connected to a printed circuit board via a flexible substrate, the cell box comprising:

a bottom plate, wherein the object to be packed is placed on the bottom plate when the object to be packed is packed in the cell box;

a plurality of sidewalls formed at a peripheral edge of the bottom plate; and a spacer configured to be switched between a first state in which one end of the spacer protrudes by a first distance from one sidewall among the plurality of sidewalls toward a side of an accommodation space configured to accommodate the object to be packed, and a second state in which the one end protrudes by a second distance shorter than the first distance from the one sidewall toward the side of the accommodation space or the one end does not protrude from the one sidewall toward the side of the accommodation space, wherein the spacer is provided slidably with respect to a sliding surface provided on the one sidewall and is slidable along a first direction intersecting an inner face of the one sidewall, the spacer is configured to be switched between the first state and the second state by sliding along the first direction, the one sidewall includes a sliding hole extending from an inner surface of the one sidewall through to an outer surface of the one sidewall along the first direction and configuring the sliding surface, and the spacer is provided slidably along the sliding hole.

2. A cell box for packing an object to be packed, the object to be packed including a display panel connected to a printed circuit board via a flexible substrate, the cell box comprising:

a bottom plate, wherein the object to be packed is placed on the bottom plate when the object to be packed is packed in the cell box;

a plurality of sidewalls formed at a peripheral edge of the bottom plate; and a spacer configured to be switched between a first state in which one end of the spacer protrudes by a first distance from one sidewall among the plurality of sidewalls toward a side of an accommodation space configured to accommodate the object to be packed, and a second state in which the one end protrudes by a second distance shorter than the first distance from the one sidewall toward the side of the accommodation space or the one end does not protrude from the one sidewall toward the side of the accommodation space, wherein the bottom plate includes a flat surface and an inclined surface, the object to be packed being placed on the flat surface when the object to be packed is packed in the cell box, the inclined surface being inclined so that a depth of the accommodation space increases toward the one sidewall, the spacer includes, on a side of the one end, a pressing surface being inclined facing or contacting the printed circuit board when the spacer is in the first state, and the pressing surface is substantially parallel to the inclined surface.

3. The cell box according to claim 1, wherein the spacer includes:

an outer end face formed on an outer face side of the spacer; and an operation portion formed in the outer end face and configured to be used at a time of changing a state of the spacer.

4. The cell box according to claim 3, wherein the operation portion includes a pair of insertion holes into which fingers of an operator are inserted.

5. The cell box according to claim 1, wherein a plurality of objects, including the object to be packed, is layered and placed on the bottom plate, and in the first state, the spacer presses the printed circuit board of an object to be packed that is layered uppermost among the plurality of objects.

6. The cell box according to claim 2, wherein the one sidewall includes:

an upper face formed on a side opposite the bottom plate; and a sliding groove formed in the upper face, extending along the first direction, and configuring a sliding surface, and the spacer is provided slidably along the sliding groove.

7. The cell box according to claim 1, wherein the display panel has a rectangular shape when viewed along a direction perpendicular to a display surface of the display panel, and the spacer is arranged at a position facing a long side of the rectangular shape.

8. The cell box according to claim 1, wherein the spacer includes a positioning projection, and a positioning groove configured to be fitted to the positioning projection is formed on the sliding surface of the one sidewall, or the one sidewall includes the positioning projection on the sliding surface, and the positioning groove is formed on the spacer.

9. The cell box according to claim 8, wherein the positioning groove includes:

a first positioning groove configured to be fitted to the positioning projection when the spacer is in the first state; and a second positioning groove configured to be fitted to the positioning projection when the spacer is in the second state.

10. The cell box according to claim 6, wherein the spacer includes a fall prevention projection, and a fall prevention groove configured to be fitted to the fall prevention projection is formed in the sliding groove, or the one sidewall further includes the fall prevention projection in the sliding groove, and the fall prevention groove is formed on the spacer.

11. The cell box according to claim 10, wherein one of the fall prevention projection or the fall prevention groove is formed along a sliding direction of the spacer on a side surface of the sliding groove, and another one of the fall prevention projection or the fall prevention groove is formed along the sliding direction of the spacer on a spacer side surface of the spacer facing the side surface of the sliding groove.

12. A cell box device comprising:

a pallet;

a plurality of cell boxes, including the cell box according to claim 1, being layered on the pallet; and a lid provided covering an uppermost cell box among the plurality of cell boxes.

* * * * *